US009530423B2

(12) United States Patent
Vos

(10) Patent No.: US 9,530,423 B2
(45) **Date of Patent: *Dec. 27, 2016**

(54) SPEECH ENCODING BY DETERMINING A QUANTIZATION GAIN BASED ON INVERSE OF A PITCH CORRELATION

(75) Inventor: Koen Bernard Vos, San Francisco, CA (US)

(73) Assignee: Skype, Dublin (IE)

( * ) Notice: Subject to any disclaimer, the term of this patent is extended or adjusted under 35 U.S.C. 154(b) by 921 days.

This patent is subject to a terminal disclaimer.

(21) Appl. No.: 12/583,998

(22) Filed: Aug. 28, 2009

(65) Prior Publication Data

US 2010/0174538 A1 Jul. 8, 2010

(30) Foreign Application Priority Data

Jan. 6, 2009 (GB) ..... 0900141.3

(51) Int. Cl.
*G10L 19/00* (2013.01)
*G10L 21/00* (2013.01)
(Continued)

(52) U.S. Cl.
CPC ..... *G10L 19/03* (2013.01); *G10L 19/02* (2013.01); *G10L 19/12* (2013.01); *G10L 21/0208* (2013.01); *G10L 25/90* (2013.01)

(58) Field of Classification Search
CPC .... G10L 19/12; G10L 21/0208; G10L 19/005; G10L 25/90
(Continued)

(56) References Cited

U.S. PATENT DOCUMENTS 4,605,961 A 8/1986 Frederiksen
4,850,022 A * 7/1989 Honda et al. ..... 704/207
(Continued)

FOREIGN PATENT DOCUMENTS

CN 1255226 5/2000
CN 1337042 2/2002
(Continued)

OTHER PUBLICATIONS

Notification of Transmittal of the International Search Report and the Written Opinion of the International Searching Authority, or the Declaration, for PCT/EP2010/050061, mailed Apr. 12, 2010.
(Continued)

*Primary Examiner* — Farzad Kazeminezhad
(74) *Attorney, Agent, or Firm* — Tom Wong; Micky Minhas

(57) ABSTRACT

A method, system and program for encoding and decoding speech according to a source-filter model whereby speech is modelled to comprise a source signal filtered by a time-varying filter. The method comprises: receiving a speech signal comprising successive frames. For each of a plurality of frames of the speech signal: adding a predetermined noise signal generated by a quantization gain multiplied by 0.5 times an inverse of a pitch correlation to the speech signal to generate a simulated signal, determining linear predictive coding coefficients based on the simulated signal frame, and determining a linear predictive coding residual signal based on the linear predictive coding coefficients and one of the speech signal and the simulated signal. Then forming an encoded signal representing said speech signal, based on the linear predictive coding coefficients and the linear predictive coding residual signal.

8 Claims, 9 Drawing Sheets

(51) Int. Cl.

| | |
|---|---|
| ***G10L 19/03*** | (2013.01) |
| ***G10L 19/02*** | (2013.01) |
| *G10L 21/0208* | (2013.01) |
| *G10L 19/12* | (2013.01) |
| *G10L 25/90* | (2013.01) |

(58) Field of Classification Search
USPC ..... 704/226
See application file for complete search history.

(56) References Cited

U.S. PATENT DOCUMENTS

| | | | | |
|---|---|---|---|---|
| 4,857,927 | A | 8/1989 | Takabayashi | |
| 4,916,449 | A | 4/1990 | Kubo et al. | |
| 4,922,537 | A | 5/1990 | Frederiksen | |
| 5,125,030 | A | 6/1992 | Nomura et al. | |
| 5,240,386 | A | 8/1993 | Amin et al. | |
| 5,253,269 | A | 10/1993 | Gerson et al. | |
| 5,327,250 | A | 7/1994 | Ikeda | |
| 5,357,252 | A | 10/1994 | Ledzius et al. | |
| 5,487,086 | A | 1/1996 | Bhaskar | |
| 5,548,680 | A | 8/1996 | Cellario | |
| 5,646,961 | A | 7/1997 | Shoham et al. | |
| 5,649,054 | A | 7/1997 | Oomen et al. | |
| 5,680,508 | A | 10/1997 | Liu | |
| 5,699,382 | A | 12/1997 | Shoham et al. | |
| 5,774,842 | A | 6/1998 | Nishio et al. | |
| 5,867,814 | A | 2/1999 | Yong | |
| 5,950,155 | A | 9/1999 | Nishiguchi | |
| 6,104,992 | A | 8/2000 | Gao et al. | |
| 6,122,608 | A | 9/2000 | McCree | |
| 6,173,257 | B1 | 1/2001 | Gao | |
| 6,188,980 | B1 | 2/2001 | Thyssen | |
| 6,260,010 | B1 | 7/2001 | Gao et al. | |
| 6,363,119 | B1 | 3/2002 | Oami | |
| 6,408,268 | B1 | 6/2002 | Tasaki | |
| 6,456,964 | B2 | 9/2002 | Manjunath et al. | |
| 6,470,309 | B1 | 10/2002 | McCree | |
| 6,493,665 | B1 | 12/2002 | Su et al. | |
| 6,502,069 | B1 | 12/2002 | Grill et al. | |
| 6,523,002 | B1 | 2/2003 | Gao et al. | |
| 6,574,593 | B1 | 6/2003 | Gao et al. | |
| 6,664,913 | B1 | 12/2003 | Craven et al. | |
| 6,751,587 | B2 * | 6/2004 | Thyssen et al. | 704/228 |
| 6,757,649 | B1 | 6/2004 | Gao et al. | |
| 6,757,654 | B1 | 6/2004 | Westerlund et al. | |
| 6,775,649 | B1 | 8/2004 | DeMartin | |
| 6,862,567 | B1 * | 3/2005 | Gao | 704/228 |
| 6,996,523 | B1 | 2/2006 | Bhaskar et al. | |
| 7,136,812 | B2 | 11/2006 | Manjunath et al. | |
| 7,143,032 | B2 | 11/2006 | Chen | |
| 7,149,683 | B2 | 12/2006 | Jelinek | |
| 7,151,802 | B1 | 12/2006 | Bessette et al. | |
| 7,171,355 | B1 * | 1/2007 | Chen | 704/226 |
| 7,252,803 | B2 | 8/2007 | Guthrie et al. | |
| 7,496,505 | B2 | 2/2009 | Manjunath et al. | |
| 7,505,594 | B2 | 3/2009 | Mauro | |
| 7,684,981 | B2 * | 3/2010 | Thumpudi et al. | 704/230 |
| 7,778,476 | B2 | 8/2010 | Alvarez et al. | |
| 7,869,993 | B2 | 1/2011 | Ojala | |
| 7,873,511 | B2 | 1/2011 | Herre et al. | |
| 8,036,887 | B2 | 10/2011 | Yasunaga et al. | |
| 8,069,040 | B2 | 11/2011 | Vos | |
| 8,078,474 | B2 | 12/2011 | Vos et al. | |
| 8,140,324 | B2 | 3/2012 | Vos et al. | |
| 8,244,526 | B2 | 8/2012 | Vos et al. | |
| 8,392,178 | B2 | 3/2013 | Vos | |
| 8,396,706 | B2 | 3/2013 | Vos | |
| 8,433,563 | B2 | 4/2013 | Vos | |
| 8,452,606 | B2 | 5/2013 | Vos | |
| 8,463,604 | B2 | 6/2013 | Vos | |
| 8,639,504 | B2 | 1/2014 | Vos | |
| 8,655,653 | B2 | 2/2014 | Vos | |
| 8,670,981 | B2 | 3/2014 | Vos et al. | |
| 8,682,652 | B2 | 3/2014 | Herre et al. | |
| 8,849,658 | B2 | 9/2014 | Vos | |
| 9,263,051 | B2 | 2/2016 | Vos | |
| 2001/0001320 | A1 | 5/2001 | Heinen et al. | |
| 2001/0005822 | A1 | 6/2001 | Fujii et al. | |
| 2001/0039491 | A1 | 11/2001 | Yasunaga et al. | |
| 2002/0032571 | A1 | 3/2002 | Leung et al. | |
| 2002/0049586 | A1 | 4/2002 | Nishio et al. | |
| 2002/0099540 | A1 | 7/2002 | Yasunaga et al. | |
| 2002/0120438 | A1 | 8/2002 | Lin | |
| 2002/0156625 | A1 | 10/2002 | Thyssen | |
| 2003/0135367 | A1 | 7/2003 | Thyssen et al. | |
| 2003/0200092 | A1 | 10/2003 | Gao et al. | |
| 2004/0102969 | A1 | 5/2004 | Manjunath et al. | |
| 2005/0007262 | A1 | 1/2005 | Craven et al. | |
| 2005/0141721 | A1 | 6/2005 | Aarts et al. | |
| 2005/0278169 | A1 | 12/2005 | Hardwick | |
| 2005/0285765 | A1 | 12/2005 | Suzuki et al. | |
| 2006/0074643 | A1 | 4/2006 | Lee et al. | |
| 2006/0235682 | A1 | 10/2006 | Yasunaga et al. | |
| 2006/0265216 | A1 | 11/2006 | Chen | |
| 2006/0271356 | A1 | 11/2006 | Vos | |
| 2006/0277039 | A1 | 12/2006 | Vos et al. | |
| 2006/0282262 | A1 | 12/2006 | Vos et al. | |
| 2007/0043560 | A1 | 2/2007 | Lee | |
| 2007/0055503 | A1 | 3/2007 | Chu et al. | |
| 2007/0064956 | A1 | 3/2007 | Iwata | |
| 2007/0088543 | A1 | 4/2007 | Ehara | |
| 2007/0100613 | A1 | 5/2007 | Yasunaga et al. | |
| 2007/0136057 | A1 | 6/2007 | Phillips | |
| 2007/0225971 | A1 | 9/2007 | Bessette | |
| 2007/0255561 | A1 | 11/2007 | Su et al. | |
| 2008/0004869 | A1 | 1/2008 | Herre et al. | |
| 2008/0015866 | A1 | 1/2008 | Thyssen et al. | |
| 2008/0091418 | A1 | 4/2008 | Laaksonen et al. | |
| 2008/0126084 | A1 | 5/2008 | Lee et al. | |
| 2008/0140426 | A1 | 6/2008 | Kim et al. | |
| 2008/0154588 | A1 | 6/2008 | Gao | |
| 2008/0275698 | A1 | 11/2008 | Yasunaga et al. | |
| 2009/0012781 | A1 * | 1/2009 | Yasunaga et al. | 704/219 |
| 2009/0043574 | A1 | 2/2009 | Gao et al. | |
| 2009/0222273 | A1 | 9/2009 | Massaloux et al. | |
| 2010/0174531 | A1 | 7/2010 | Bernard Vos | |
| 2010/0174532 | A1 | 7/2010 | Vos et al. | |
| 2010/0174534 | A1 | 7/2010 | Vos | |
| 2010/0174541 | A1 | 7/2010 | Vos | |
| 2010/0174542 | A1 | 7/2010 | Vos | |
| 2010/0174547 | A1 | 7/2010 | Vos | |
| 2011/0077940 | A1 | 3/2011 | Vos et al. | |
| 2011/0173004 | A1 | 7/2011 | Bessette et al. | |
| 2013/0262100 | A1 | 10/2013 | Vos | |
| 2014/0142936 | A1 | 5/2014 | Vos | |
| 2014/0163973 | A1 | 6/2014 | Vos | |
| 2014/0358531 | A1 | 12/2014 | Vos | |

FOREIGN PATENT DOCUMENTS

| | | |
|---|---|---|
| CN | 1653521 | 8/2005 |
| EP | 0501421 | 9/1992 |
| EP | 0550990 | 7/1993 |
| EP | 0610906 | 8/1994 |
| EP | 0720145 | 7/1996 |
| EP | 0724252 | 7/1996 |
| EP | 0849724 | 6/1998 |
| EP | 0877355 | 11/1998 |
| EP | 0957472 | 11/1999 |
| EP | 1093116 | 4/2001 |
| EP | 1255244 | 11/2002 |
| EP | 1 326 235 A2 | 7/2003 |
| EP | 1758101 | 2/2007 |
| EP | 1903558 | 3/2008 |
| GB | 2466669 | 7/2010 |
| GB | 2466670 | 7/2010 |
| GB | 2466671 | 7/2010 |
| GB | 2466672 | 7/2010 |
| GB | 2466673 | 7/2010 |
| GB | 2466674 | 7/2010 |
| GB | 2466675 | 7/2010 |
| JP | 1205638 | 10/1987 |
| JP | 2287400 | 4/1989 |

(56) References Cited

FOREIGN PATENT DOCUMENTS

| | | |
|---|---|---|
| JP | 4312000 | 4/1991 |
| JP | 7306699 | 5/1994 |
| JP | 2007279754 | 10/2007 |
| WO | WO-9103790 | 3/1991 |
| WO | WO-9403988 | 2/1994 |
| WO | WO-9518523 | 7/1995 |
| WO | WO-9918565 | 4/1999 |
| WO | WO-9963521 | 12/1999 |
| WO | WO-0103122 | 1/2001 |
| WO | WO-0191112 | 11/2001 |
| WO | WO-03052744 | 6/2003 |
| WO | WO-2005009019 | 1/2005 |
| WO | WO-2008046492 | 4/2008 |
| WO | WO-2008056775 | 5/2008 |
| WO | WO-2010079163 | 7/2010 |
| WO | WO-2010079164 | 7/2010 |
| WO | WO-2010079165 | 7/2010 |
| WO | WO-2010079166 | 7/2010 |
| WO | WO-2010079167 | 7/2010 |
| WO | WO-2010079170 | 7/2010 |
| WO | WO-2010079171 | 7/2010 |

OTHER PUBLICATIONS

Makhoul, J. Berouti, M., "Adaptive Noise Spectral Shaping and Entropy Coding in Predictive Coding of Speech," IEEE, Transactions on Acoustics, Speech and Signal Processing, ASSP-27(1) 63-73 (1979).

Bishnu, S., et al., "Predictive Coding of Speech Signals and Subjective Error Criteria," IEEE, Transactions on Acoustics, Speech and Signal Processing, ASSP 27(3)247-254 (1979).

Mahé, G., and Gilloire, A., "Quantization Noise Spectral Shaping in Instantaneous Coding of Spectrally Unbalanced Speech Signals," IEEE, Speech Coding Workshop, 56-58 (2002).

"Foreign Office Action", Great Britain Application No. 0900145.4, (May 28, 2012), 2 pages.

"Non-Final Office Action", U.S. Appl. No. 12/455,157, (Aug. 6, 2012), 15 pages.

"Non-Final Office Action", U.S. Appl. No. 12/455,632, (Aug. 22, 2012), 14 pages.

Search Report for Application No. GB0900141.3, filed Jan. 6, 2009, dated Apr. 30, 2009, 3 pages.

"Coding of Speech at 8 kbit/s Using Conjugate-Structure Algebraic-Code-Excited Linear-Prediction (CS-ACELP)", *International Telecommunication Union, ITUT*, (1996), 39 pages.

"International Search Report and Written Opinion", Application No. PCT/EP2010/050060, (Apr. 14, 2010), 14 pages.

"International Search Report and Written Opinion", Application No. PCT/EP2010/050057, (Jun. 24, 2010), 11 pages.

"International Search Report and Written Opinion", Application No. PCT/EP2010/050053, (May 17, 2010), 17 pages.

"International Search Report and Written Opinion", Application No. PCT/EP2010/050052, (Jun. 21, 2010), 13 pages.

"International Search Report and Written Opinion", Application No. PCT/EP2010/050051, (Mar. 15, 2010), 13 pages.

"International Search Report and Written Opinion", Application No. PCT/EP2010/050056, (Mar. 29, 2010), 8 pages.

"Non-Final Office Action", U.S. Appl. No. 12/455,100, (Jun. 8, 2012), 8 pages.

"Non-Final Office Action", U.S. Appl. No. 12/455,632, (Oct. 18, 2011), 14 pages.

"Non-Final Office Action", U.S. Appl. No. 12/455,632, (Feb. 6, 2012), 18 pages.

"Non-Final Office Action", U.S. Appl. No. 12/455,712, (Jun. 20, 2012) ,8 pages.

"Non-Final Office Action", U.S. Appl. No. 12/455,752, (Jun. 15, 212), 8 pages.

"Non-Final Office Action", U.S. Appl. No. 12/586,915, (May 8, 2012), 10 pages.

"Notice of Allowance", U.S. Appl. No. 12/455,632, (May 15, 2012), 7 pages.

"Search Report", Application No. GB 0900139.7, (Apr. 17, 2009), 3 pages.

"Search Report", Application No. GB 0900142.1, (Apr. 21, 2009), 2 pages.

"Search Report", Application No. GB 0900144.7, (Apr. 24, 2009), 2 pages.

"Search Report", Application No. GB0900143.9, (Apr. 28, 2009), 1 page.

"Search Report", Application No. GB0900145.4, (Apr. 27, 2009), 1 page.

"Wideband Coding of Speech at Around 1 kbit/sUsing Adaptive Multi-rate Wideband (AMR-WB)", *International Telecommunication Union G.722.2*, (2002), pp. 1-65.

Chen, Juin-Hwey "Novel Codec Structures for Noise Feedback Coding of Speech", *IEEE* (2006),pp. 681-684.

Chen, L "Subframe Interpolation Optimized Coding of LSF Parameters", *IEEE*, (Jul. 2007), pp. 725-728.

Denckla, Ben "Subtractive Dither for Internet Audio", *Journal of the Audio Engineering Society*, vol. 46, Issue 7/8, (Jul. 1998), pp. 654-656.

Ferreira, C R., et al., "Modified Interpolation of LSFs Based on Optimization of Distortion Measures", *IEEE*, (Sep. 2006), pp. 777-782.

Gerzon, et al., "A High-Rate Buried-Data Channel for Audio CD", Journal of Audio Engineering Society, vol. 43, No. 1/2,(Jan. 1995), 22 pages.

Haagen, J et al., "Improvements in 2.4 KBPS High-Quality Speech Coding", *IEEE*, (Mar. 1992), pp. 145-148.

Islam, T et al., "Partial-Energy Weighted Interpolation of Linear Prediction Coefficients", *IEEE*, (Sep. 2000), pp. 105-107.

Jayant, N S., et al., "The Application of Dither to the Quantization of Speech Signals", *Program of the 84th Meeting of the Acoustical Society of America*. (Abstract Only), (Nov.-Dec. 1972), pp. 1293-1304.

Lupini, Peter et al., "A Multi-Mode Variable Rate Celp Coder Based on Frame Classification", *Proceedings of the International Conference on Communications* (*ICC*), *IEEE 1*, (1993), pp. 406-409.

Martins Da Silva, L et al., "Interpolation-Based Differential Vector Coding of Speech LSF Parameters", *IEEE*, (Nov. 1996), pp. 2049-2052.

Rao, A V., et al., "Pitch Adaptive Windows for Improved Excitation Coding in Low-Rate CELP Coders", *IEEE Transactions on Speech and Audio Processing*, (Nov. 2003), pp. 648-659.

Salami, R "Design and Description of CS-ACELP: A Toll Quality 8 kb/s Speech Coder", *IEEE*, 6(2), (Mar. 1998), pp. 116-130.

"Examination Report under Section 18(3)", Great Britain Application No. 0900143.9, (May 21, 2012), 2 pages.

"Examination Report", GB Application No. 0900140.5, (Aug. 29, 2012), 3 pages.

"Examination Report", GB Application No. 0900141.3, (Oct. 8, 2012), 2 pages.

"Final Office Action", U.S. Appl. No. 12/455,100, (Oct. 4, 2012), 5 pages.

"Final Office Action", U.S. Appl. No. 12/455,632, (Jan. 18, 2013),15 pages.

"Final Office Action", U.S. Appl. No. 12/455,752, (Nov. 23, 2012), 8 pages.

"Foreign Office Action", CN Application No. 201080010208.1. (Dec. 28, 2012),12 pages.

"Non-Final Office Action", U.S. Appl. No. 12/586,915, (Sep. 25, 2012),10 pages.

"Notice of Allowance", U.S. Appl. 12/455,100, (Feb. 5, 2013), 4 Pages.

"Notice of Allowance", U.S. Appl. No. 12/455,157, (Nov. 29, 2012), 9 pages.

"Notice of Allowance", U.S. Appl. No. 12/455,478, (Dec. 7, 2012), 7 pages.

"Notice of Allowance", U.S. Appl. No. 12/455,712, (Oct. 23, 2012), 7 pages.

"Notice of Allowance", U.S. Appl. No. 12/586,915, (Jan. 22, 2013), 8 pages.

(56) References Cited

OTHER PUBLICATIONS

"Search Report", GB Application No. 0900140.5, (May 5, 2009), 3 pages.
"Supplemental Notice of Allowance", U.S. Appl. No. 12/455,157, (Jan. 22, 2013), 2 pages.
"Supplemental Notice of Allowance", U.S. Appl. No. 12/455,157, (Feb. 8, 2013), 2 pages.
"Supplemental Notice of Allowance", U.S. Appl. No. 12/455,478, (Jan. 11, 2013), 2 pages.
"Supplemental Notice of Allowance", U.S. Appl. No. 12/455,712, (Dec. 19, 2012), 2 pages.
"Supplemental Notice of Allowance", U.S. Appl. No. 12/455,712, (Jan. 14, 2013), 2 pages.
"Supplemental Notice of Allowance", U.S. Appl. No. 12/455,712, (Feb. 5, 2013), 2 pages.
"Foreign Notice of Allowance", CN Application No. 201080010209.6, Apr. 1, 2014, 3 pages.
"Notice of Allowance", U.S. Appl. No. 14/162,707, May 9, 2014, 6 pages.
"Foreign Office Action", Chinese Application No. 201080010209, (Jan. 30, 2013),12 pages.
"Non-Final Office Action", U.S. Appl. No. 13/905,864, (Aug. 15, 2013), 6 pages.
"Non-Final Office Action", U.S. Appl. No. 12/455,632, (Jun. 4, 2013), 13 pages.
"Supplemental Notice of Allowance", U.S. Appl. No. 12/455,100, (Apr. 4, 2013), 2 pages.
"Supplemental Notice of Allowance", U.S. Appl. No. 12/455,100, (May 16, 2013), 2 pages.
"Supplemental Notice of Allowance", U.S. Appl. No. 12/455,478, (Mar. 28, 2013), 3 pages.
"Corrected Notice of Allowance", U.S. Appl. No. 14/162,707, Sep. 3, 2014, 5 pages.
"Foreign Notice of Allowance", EP Application No. 10700158.8, Jun. 3, 2014, 7 pages.
"Foreign Office Action", EP Application No. 10700158.8, Oct. 15, 2013, 4 pages.
"Supplemental Notice of Allowance", U.S. Appl. No. 12/455,752, Jan. 30, 2014, 2 pages.
"Supplemental Notice of Allowance", U.S. Appl. No. 13/905,864, Jan. 3, 2014, 2 pages.
"Supplemental Notice of Allowance", U.S. Appl. No. 12/455,752, Dec. 16, 2013, 2 pages.
"Supplemental Notice of Allowance", U.S. Appl. No. 12/455,632, Jan. 22, 2014, 4 pages.
"Notice of Allowance", U.S. Appl. No. 12/455,632, (Oct. 9, 2013), 8 pages.
"Notice of Allowance", U.S. Appl. No. 12/455,752, (Oct. 4, 2013), 6 pages.
"Notice of Allowance", U.S. Appl. No. 13/905,864, (Sep. 17, 2013), 5 pages.
"Foreign Notice of Allowance", EP Application No. 10700157.0, Oct. 17, 2014, 6 pages.
"Foreign Office Action", EP Application No. 10700157.0, Oct. 15, 2013, 5 pages.
"Non-Final Office Action", U.S. Appl. No. 14/182,196, Nov. 25, 2014, 18 pages.
"Non-Final Office Action", U.S. Appl. No. 14/459,984, Oct. 28, 2014, 4 pages.
"Summons to Attend Oral Proceedings", EP Application No. 10700157.0, May 30, 2014, 6 pages.
"Non-Final Office Action", U.S. Appl. No. 14/459,984, Sep. 29, 2015, 5 pages.
"Notice of Allowance", U.S. Appl. No. 14/182,196, Oct. 14, 2015, 7 pages.
"Supplemental Notice of Allowance", U.S. Appl. No. 14/182,196, Jan. 14, 2016, 4 pages.
"Final Office Action", U.S. Appl. No. 14/182,196, Mar. 3, 2015, 25 pages.
"Final Office Action", U.S. Appl. No. 14/459,984, May 1, 2015, 5 pages.
"Final Office Action", U.S. Appl. No. 14/459,984, May 19, 2016, 6 pages.

* cited by examiner

SPEECH ENCODING BY DETERMINING A QUANTIZATION GAIN BASED ON INVERSE OF A PITCH CORRELATION

RELATED APPLICATION

This application claims priority under 35 U.S.C. §119 or 365 to Great Britain Application No. 0900141.3, filed Jan. 6, 2009. The entire teachings of the above application are incorporated herein by reference.

FIELD OF THE INVENTION

The present invention relates to the encoding of speech for transmission over a transmission medium, such as by means of an electronic signal over a wired connection or electro-magnetic signal over a wireless connection.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal with each period comprising a series of pulses of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising four pulses which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*.

The spectral envelope signal and the source signal are each encoded separately for transmission. In the illustrated example, each subframe 106 would contain: (i) a set of parameters representing the spectral envelope 204; and (ii) a set of parameters representing the pulses of the source signal 202.

In the illustrated example, each subframe 106 would comprise: (i) a quantised set of LPC parameters representing the spectral envelope, (ii)(a) a quantised LTP vector related to the correlation between pitch-periods in the source signal, and (ii)(b) a quantised LTP residual signal representative of the source signal with the effects of both the inter-period correlation and the spectral envelope removed.

The residual signal comprises information present in the original input speech signal that is not represented by the quantized LPC parameters and LTP vector. This information must be encoded and sent with the LPC and LTP parameters in order to allow the encoded speech signal to be accurately synthesized at the decoder. In order to reduce the bit rate required for transmitting the encoded speech signal, it is preferable to minimize the energy of the residual signal, and therefore minimize the bit rate required to encode the residual signal.

It is an aim of some embodiments of the present invention to address, or at least mitigate, some of the above identified problems of the prior art.

SUMMARY

According to an aspect of the invention, there is provided a method of encoding a speech signal according to a source-filter model, whereby speech is modelled to comprise a source signal filtered by the time-varying filter, the method comprising receiving a speech signal comprising successive frames, for each of a plurality of frames of the input speech signal, adding a predetermined noise signal to the input speech signal to generate a simulated signal, determining linear predictive coding coefficients based on the simulated signal frame, and determining a linear predictive coding residual signal based on the speech input signal and the linear predictive coding coefficients, and forming an encoded signal representing said speech signal, based on the linear predictive coding coefficients and the linear predictive coding residual signal.

In embodiments, the method may further comprise generating a quantized residual signal based on the linear predictive coding residual signal.

Generating a quantized residual signal may further generate an associated quantization noise signal, and the predetermined noise signal comprises white noise may have a variance equal to a variance of the quantization noise.

The predetermined noise signal may be generated by combining a white noise signal with a quantization gain value. The quantization gain value may be generated in a noise shaping analysis.

Forming the encoded signal may comprise arithmetically encoding the quantized residual signal and the linear predictive coding coefficients.

According to a further aspect of the invention, there is provided an encoder for encoding speech according to a source-filter model whereby speech is modelled to comprise a source signal filtered by a time-varying filter, the encoder comprising an input arranged to receive a speech signal comprising successive frames, a first signal-processing module configured to generate, for each of a plurality of frames of the speech signal, a simulated signal frame by adding a predetermined noise signal to the input speech signal frame, a second signal-processing module configured to determine linear predictive coding coefficients based on the simulated signal frame, the second signal-processing module further configured to determine a linear predictive coding residual signal based on the input speech signal and the linear predictive coding coefficients, and a third signal-processing module configured to form an encoded signal representing the speech signal, based on the linear predictive coding coefficients and the linear predictive coding residual signal.

The encoder may further comprise a fourth signal-processing module configured to generate a quantized residual signal based on the linear predictive coding residual signal.

The second signal-processing module may comprise a linear predictive coding analysis module. The forth signal-processing module may comprise a noise shaping quantizer module.

According to further aspects of the present invention, there are provided corresponding computer program products and client application products arranged so as when executed on a processor they perform the methods described above.

According to another aspect of the present invention, there is provided a communication system comprising a plurality of end-user terminals each comprising a corresponding encoder and/or decoder.

BRIEF DESCRIPTION OF THE DRAWINGS

Embodiments of the present invention will now be described by way of example only, and with reference to the accompanying figures, in which.

DETAILED DESCRIPTION OF EMBODIMENTS

Embodiments of the invention are described herein by way of particular examples and specifically with reference to exemplary embodiments. It will be understood by one skilled in the art that the invention is not limited to the details of the specific embodiments given herein.

Figure 1A:
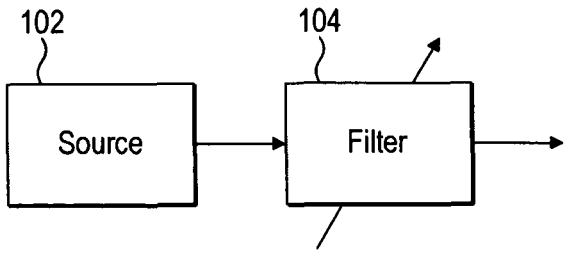
FIG. 1*a* is a schematic representation of a source-filter model of speech.
Figure 1B:
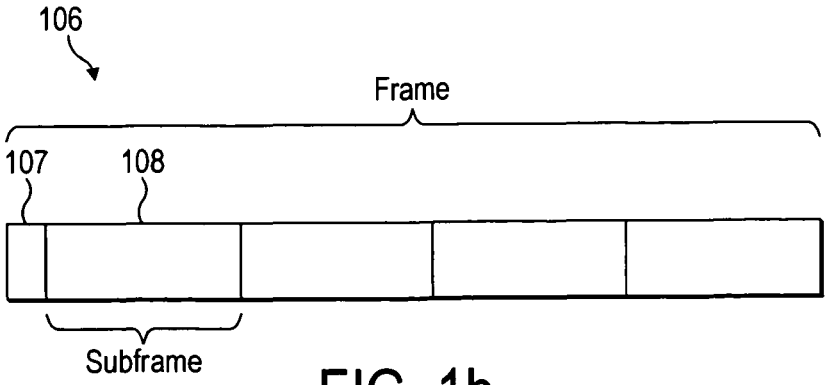
FIG. 1*b* is a schematic representation of a frame.
Figure 2A:
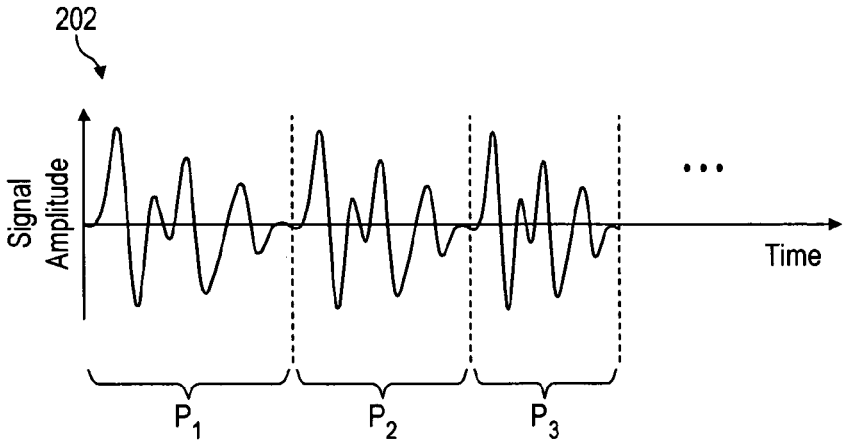
FIG. 2*a* is a schematic representation of a source signal.
Figure 2B:
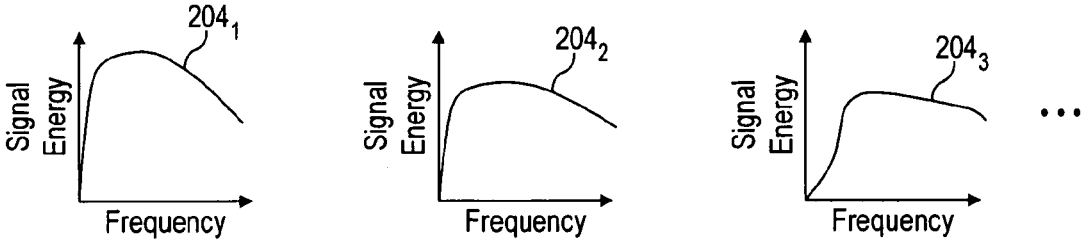
FIG. 2*b* is a schematic representation of variations in a spectral envelope.
Figure 3:
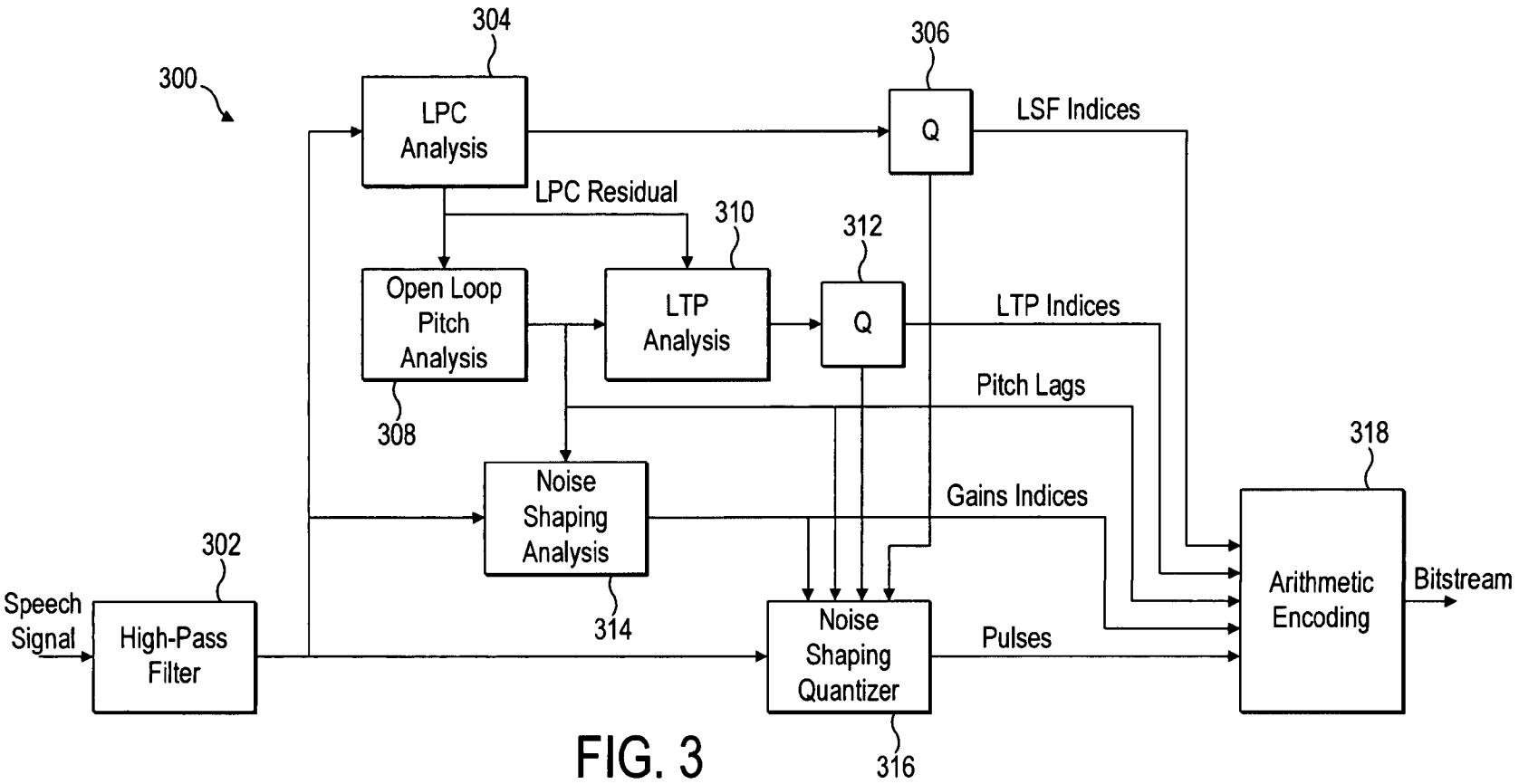
FIG. 3 shows a linear predictive speech encoder.

FIG. 3 shows a speech encoder based on the linear prediction quantization paradigm. The encoder 300 of FIG. 3 comprises a high-pass filter 302, a linear predictive coding (LPC) analysis block 304, a first vector quantizer 306, an open-loop pitch analysis block 308, a long-term prediction (LTP) analysis block 310, a second vector quantizer 312, a noise shaping analysis block 314, a noise shaping quantizer 316, and an arithmetic encoding block 318.

The high pass filter 302 has an input arranged to receive an input speech signal from an input device such as a microphone, and an output coupled to inputs of the LPC analysis block 304, noise shaping analysis block 314 and noise shaping quantizer 316. The LPC analysis block 304 has an output coupled to an input of the first vector quantizer 306. The first vector quantizer 306 has an output coupled to inputs of the arithmetic encoding block 318 and noise shaping quantizer 316.

The LPC analysis block 304 has outputs coupled to inputs of the open-loop pitch analysis block 308 and the LTP analysis block 310. The LTP analysis block 310 has an output coupled to an input of the third vector quantizer 312, and the third vector quantizer 312 has outputs coupled to inputs of the arithmetic encoding block 318 and noise shaping quantizer 316. The open-loop pitch analysis block 308 has outputs coupled to inputs of the LTP analysis block 310 and the noise shaping analysis block 314. The noise shaping analysis block 314 has outputs coupled to inputs of the arithmetic encoding block 318 and the noise shaping quantizer 316. The noise shaping quantizer 316 has an output coupled to an input of the arithmetic encoding block 318. The arithmetic encoding block 318 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes encoded parameters, and has a bitrate that varies depending on a quality setting provided to the encoder and on the complexity and perceptual importance of the input signal.

The speech signal is high-pass filtered by high-pass filter 302 and input to the linear predictive coding (LPC) analysis 304 which determines 16 LPC coefficients. The LPC analysis whitens the high-pass filtered input signal based on the 16 LPC coefficients thereby creating an LPC residual signal. The LPC residual signal is used by the open loop pitch analysis 308 which determines one or more pitch lags for the frame. For frames classified as voiced, the long-term prediction (LTP) analysis 310 uses the LPC residual to find one or more sets of LTP coefficients. The LPC and LTP coefficients together constitute the short-term and long-term prediction parameters, which are optimized to minimize the energy of the residual after removing the short-term and long-term predictive component from the filtered input signal. The prediction parameters are quantized and sent to a decoder 500. The noise shaping analysis 314 on the high-pass filtered input signal determines noise shaping filter coefficients and quantization gains. The noise shaping filter parameters and quantization gains, together with the quantized prediction coefficients are used by the noise shaping quantizer 316 to create a quantized representation of the residual signal which can be used in the decoder together with the quantized prediction coefficients, pitch lags and quantization gains to construct a decoded speech signal.

Figure 4:
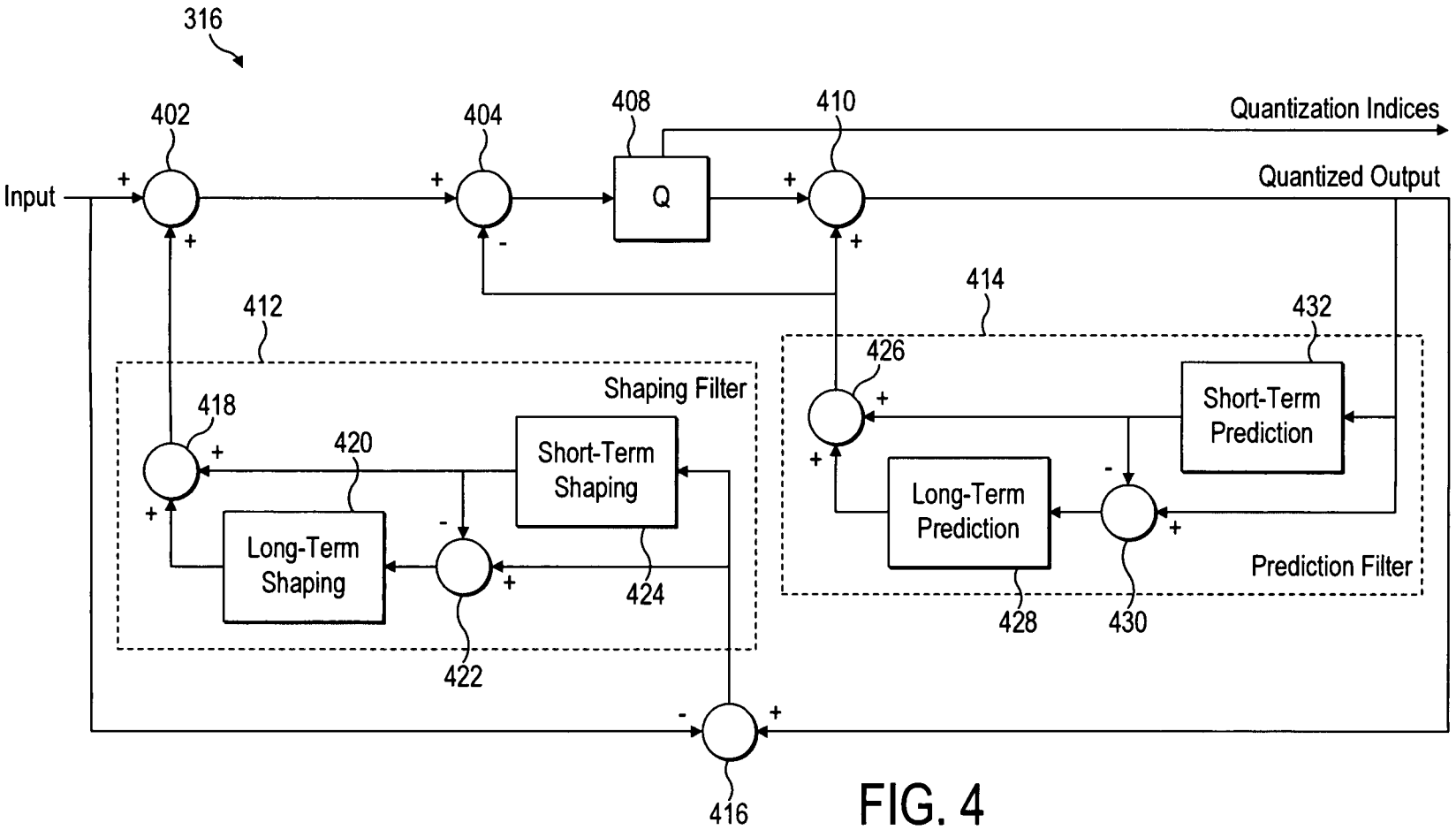
FIG. 4 shows a more detailed representation of noise shaping interpolator of FIG. 3.

FIG. 4 shows a noise shaping quantizer that combines short-term and long-term noise shaping and short-term and long-term prediction.

The noise shaping quantizer 316 comprises a first addition stage 402, a first subtraction stage 404, a scalar quantizer 408, a second addition stage 410, a shaping filter 412, a prediction filter 414 and a second subtraction stage 416. The shaping filter 412 comprises a third addition stage 418, a long-term shaping block 420, a third subtraction stage 422, and a short-term shaping block 424. The prediction filter 414 comprises a fourth addition stage 426, a long-term prediction block 428, a fourth subtraction stage 430, and a short-term prediction block 432.

The first addition stage 402 has an input arranged to receive the high-pass filtered input from the high-pass filter 302, and another input coupled to an output of the third addition stage 418. The first subtraction stage has inputs coupled to outputs of the first addition stage 402 and fourth addition stage 426. An output of the first subtraction stage is coupled to an input of the scalar quantizer 408. The scalar quantiser 408 has outputs coupled to inputs of the second addition stage 410 and the arithmetic encoding block 318. The other input of the second addition stage 410 is coupled to an output of the fourth addition stage 426. An output of the second addition stage is coupled back to the input of the first addition stage 402, and to an input of the short-term prediction block 432 and the fourth subtraction stage 430. An output of the short-term prediction block 432 is coupled to the other input of the fourth subtraction stage 430. The fourth addition stage 426 has inputs coupled to outputs of the long-term prediction block 428 and short-term prediction block 432. The output of the second addition stage 410 is further coupled to an input of the second subtraction stage 416, and the other input of the second subtraction stage 416 is coupled to the input from the high-pass filter 302. An output of the second subtraction stage 416 is coupled to inputs of the short-term shaping block 424 and the third subtraction stage 422. An output of the short-term shaping block 424 is coupled to the other input of the third subtraction stage 422. The third addition stage 418 has inputs coupled to outputs of the long-term shaping block 420 and short-term prediction block 424.

The purpose of the noise shaping quantizer 316 is to quantize the LTP residual signal in a manner that weights the distortion noise created by the quantisation into parts of the frequency spectrum where the human ear is more tolerant to noise.

In operation, all gains and filter coefficients and gains are updated for every subframe, except for the LPC coefficients, which are updated once per frame.

The noise shaping quantizer 316 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 412, described in detail later. The output of the shaping filter 412 is added to the input signal at the first addition stage 402 in order to effect the spectral shaping of the quantization noise. From the resulting signal, the output of the prediction filter 414, described in detail below, is subtracted at the first subtraction stage 404 to create a residual signal. The residual signal is input to the scalar quantizer 408. The quantization indices of the scalar quantizer 408 represent an excitation signal that is input to the arithmetically encoder 318. The scalar quantizer 408 also outputs a quantization signal. The output of the prediction filter 414 is added at the second addition stage to the quantization signal to form the quantized output signal. The quantized output signal is input to the prediction filter 414.

The prediction filter 414 combines the outputs of a short-term (LPC) predictor and a long-term (LTP) predictor. The difference between quantized output signal and input signal is the coding noise signal, which is input to the shaping filter 412. The shaping filter combines the outputs of short-term and long-term shaping filters.

The LPC and LTP coefficients determined in the LPC and LTP analyses of FIG. 3 are optimized to minimize the energy of residual signal after filtering the input signal first with an LPC analysis filter 304 and then with an LTP analysis filter 310.

The energy of the residual signal is minimized by removing correlations between samples of the residual signal; or in other words, the residual signal is a whitened version of the input signal. In FIG. 4, in order to minimize the bitrate for the encoded signal, the quantization indices should be maximally uncorrelated.

However, this is not guaranteed by the way the LPC and LTP analyses are performed. This is because for the quantization indices to be uncorrelated, the LPC and LTP analysis filters should whiten the quantized output signal, rather than the speech input signal. The quantized output signal may differ significantly from the input signal, especially when coding at low bitrates, as is often the case in order to ensure efficient use of network resources.

According to an embodiment of the invention, a signal is generated in the encoder that matches the spectral characteristics of the output signal. By performing short-term and long-term prediction analysis on this simulated signal instead of on the input signal, the prediction gain of the prediction filters is improved. This results in a lower entropy of the quantization indices, thus reducing the bitrate.

The predictive noise shaping quantizer 316 of FIG. 4 generates a quantized output signal y(n) that can be described in the z-domain as $$Y(z) = X(z) + \frac{Q(z)}{1 - F(z)},$$

where X(z), Q(z) and F(z) are the z-transforms of the input signal, the quantization noise (i.e., quantizer output minus quantizer input) and the shaping filter, respectively. The prediction filter 414 has little impact on the output signal, because the output of the prediction filter 414 is first subtracted (before quantization) and then added again (after quantization). Therefore, a simulated output signal can be generated that has spectral characteristics similar to the final quantized output signal, by adding to the input signal a filtered noise signal. The noise signal may be chosen such as to have spectral properties similar to the quantization noise signal, and can be a white noise with variance equal to the expected quantization noise variance. Performing LPC and LTP analysis on the simulated output signal leads to prediction coefficients that correspond to a whiter quantizer output signal, thus reducing the bitrate.

Figure 5:
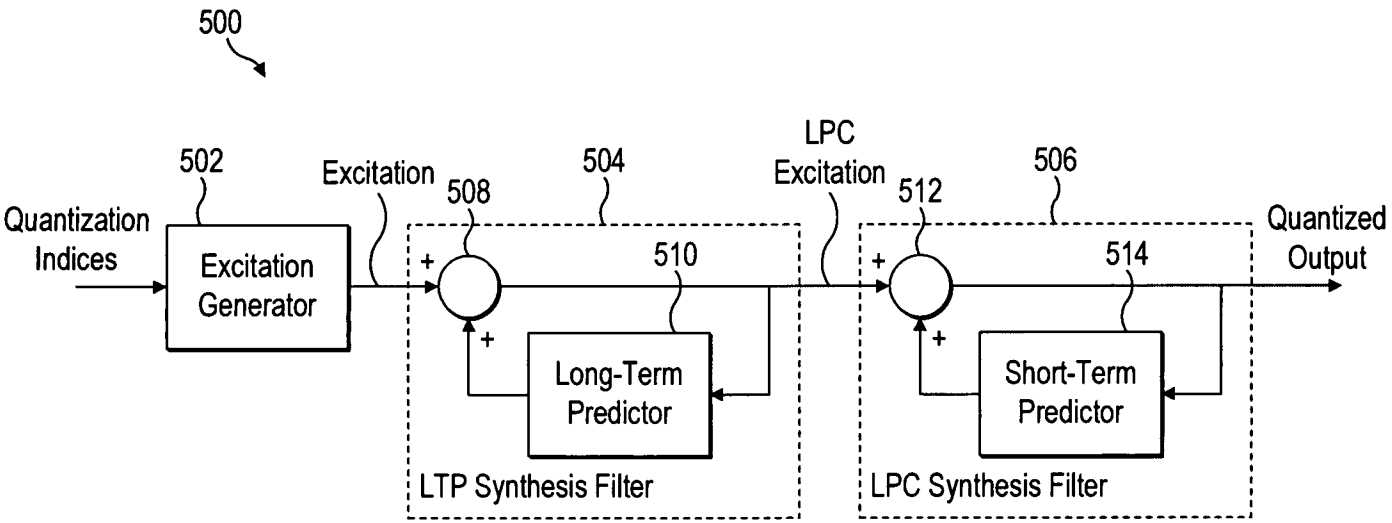
FIG. 5 shows a linear predictive speech decoder.

FIG. 5 shows a linear predictive speech decoder 500 suitable for decoding a speech signal encoded using the encoder of FIG. 3. The speech decoder 500 of FIG. 5 comprises an Excitation Generator 502, a long term prediction synthesis filter 504 and a linear predictive coding synthesis filter 506. Long term analysis synthesis filter 504 comprises long term predictor 508 and first summing stage 510. Linear predictive coding synthesis filter 506 comprises short-term predictor 512 and second summing stage 514.

Quantization indices are input to the excitation generator 502 which generates an excitation signal. The output of a long term predictor 508 is added to the excitation signal in first summing stage 510, which creates the LPC excitation signal. The LPC excitation signal is input to the long-term predictor 508, which is a strictly causal MA filter controlled by the pitch lag and quantized LTP coefficients. The output of a short term predictor 512 is added to the LPC excitation signal in the second summing stage 514, which creates the quantized output signal. The quantized output signal is input to the short-term predictor 512, which is a strictly causal MA filter controlled by the quantized LPC coefficients.

Figure 6:
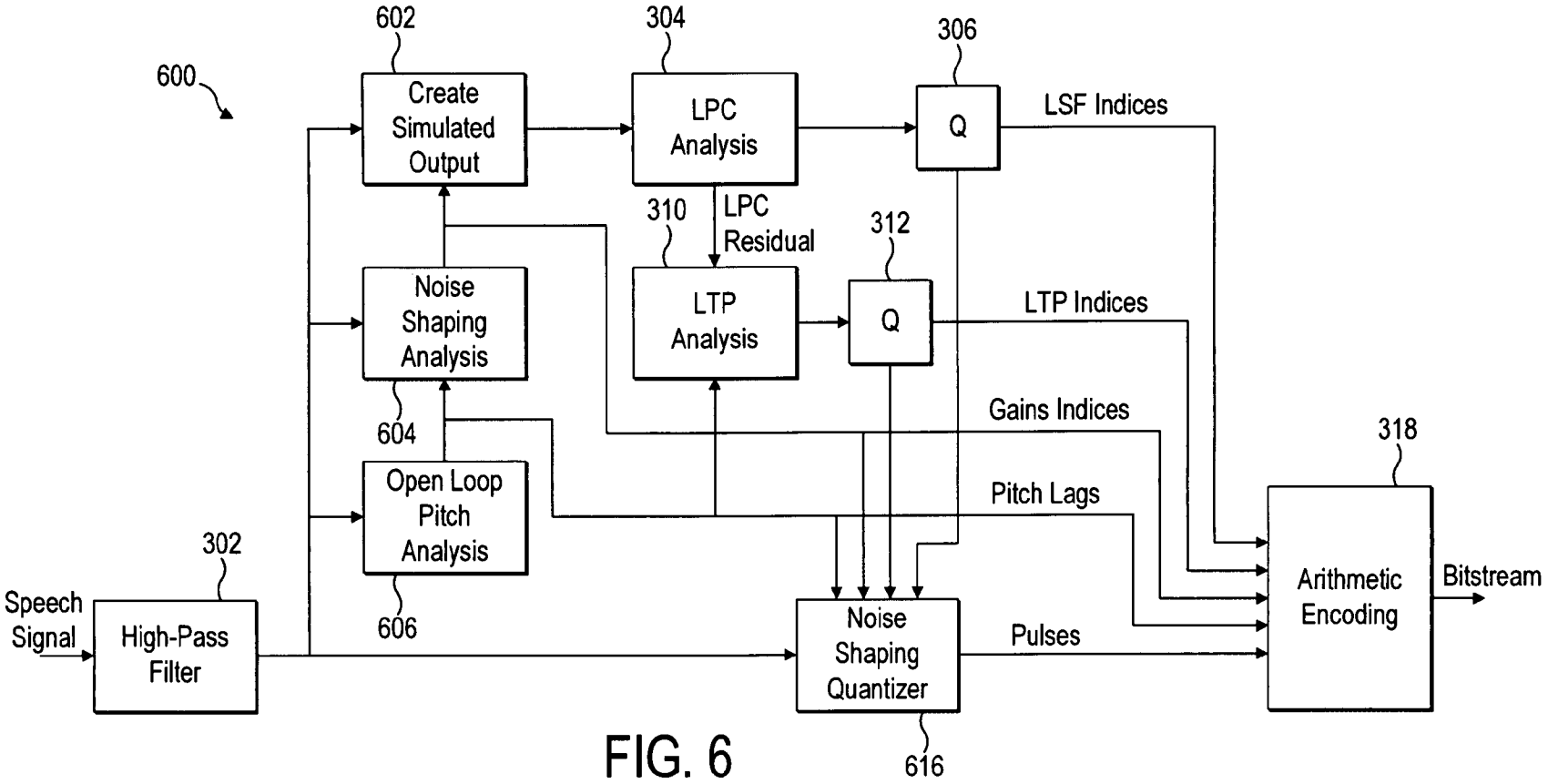
FIG. 6 shows an encoder according to an embodiment of the invention.

FIG. 6 shows an encoder 600 according to an embodiment of the invention. The encoder 600 is similar to the encoder of FIG. 3, and further comprises a output signal simulation block 602, and modified noise shaping analysis block 604 and open loop pitch analysis block 606.

The high pass filter 302 has an input arranged to receive an input speech signal from an input device such as a microphone, and an output coupled to inputs of the output signal simulation block 602, noise shaping analysis block 604 and open loop pitch analysis block 606. Open loop pitch analysis block 606 has an output connected to inputs of the noise shaping analysis block 604 and the noise shaping quantizer 616. The noise shaping analysis block 604 has an output. connected to inputs of the output signal simulation block 606, and the noise shaping quantizer 616. The output signal simulation block 602 has an output connected to an input of the LPC analysis block 304.

The LPC analysis block 304 has outputs coupled to inputs of the first vector quantizer 306 and the LTP analysis block 610. The first vector quantizer 306 has an output coupled to an input of the arithmetic encoding block 318 and noise shaping quantizer 616.

The LPC analysis block 304 has an output coupled to input of the LTP analysis block 310. The LTP analysis block 310 has an output coupled to an input of the second vector quantizer 312, and the second vector quantizer 312 has outputs coupled to inputs of the arithmetic encoding block 318 and noise shaping quantizer 616

The noise shaping quantizer 616 has an output coupled to an input of the arithmetic encoding block 618. The arithmetic encoding block 618 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes encoded parameters, and has a bitrate that varies depending on a quality setting provided to the encoder and on the complexity and perceptual importance of the input signal.

The speech input signal is input to the high-pass filter 302 to remove frequencies below 80 Hz which contain almost no speech energy and may contain noise that can be detrimental to the coding efficiency and cause artifacts in the decoded output signal. The high-pass filter 302 is preferably a second order auto-regressive moving average (ARMA) filter.

The high-pass filtered input signal is input to the open loop pitch analysis 606 producing one pitch lag for every 5 millisecond sub frame, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 318 and noise shaping quantizer 616.

The high-pass filtered input is analyzed by the noise shaping analysis block 604 to find the filter coefficients and quantization gains used in the noise shaping quantizer 616. The filter coefficients determine the distribution over the quantization noise over the spectrum, and are chosen such that the quantization is least audible. The quantization gains determine the step size of the residual quantizer and as such govern the balance between bitrate and quantization noise level.

All noise shaping parameters are computed and applied per subframes of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder. The quantized quantization gains are input to the noise shaping quantizer 616.

A set of short-term noise shaping coefficients $a_{shape}(i)$ is determined by applying bandwidth expansion to the coefficients found in the noise shaping LPC analysis. This bandwidth expansion moves the roots of the noise shaping LPC polynomial towards the origin, according to the formula $$a_{shape}(i)=a_{autocorr}(i)\ gi$$

where $a_{autocorr}(i)$ is the $i^{th}$ coefficient from the noise shaping LPC analysis and for the bandwidth expansion factor g a value of 0.94 was found to give good results.

For voiced frames, the noise shaping quantizer 616 also applies long-term noise shaping. It uses three filter taps, described by:

$$b\text{shape}=0.5\ \text{sqrt(PitchCorrelation)}\ [0.25, 0.5, 0.25].$$

The short-term and long-term noise shaping coefficients are input to the noise shaping quantizer 616.

Figure 7:
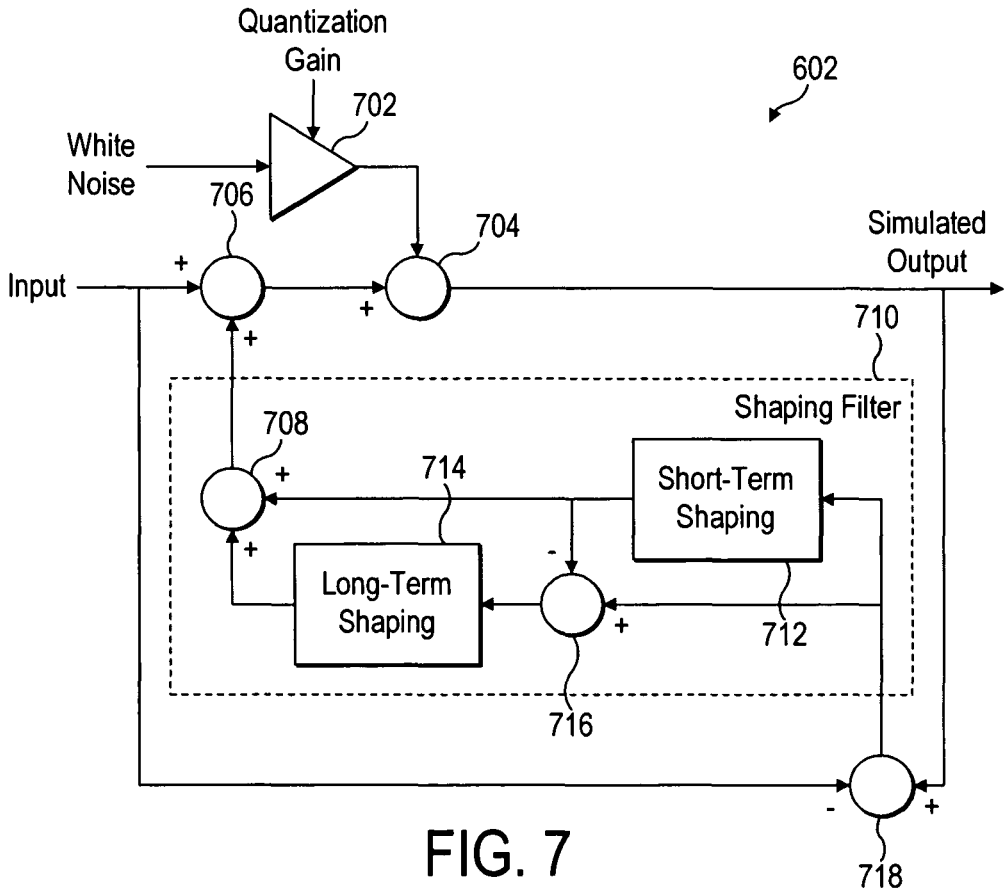
FIG. 7 shows a detailed view of the create simulated output block of FIG. 6.

The high-pass filtered input is input to a module that creates a simulated output signal 602. The output signal simulation block 602 is shown in FIG. 7, and comprises amplifier 702, first summing stage 704, second summing stage 706, first subtraction stage 718 and shaping filter 710. Shaping filter 710 comprises third summing stage 708, long-term shaping filter 714 and short-term shaping filter 712.

An input signal is input to a first input of second summing stage 706, and an output of shaping filter 710 is coupled to a second input of summing stage 706. The output of second summing stage 706 comprises a first input to first summing stage 704. A white noise signal is applied to an input of amplifier 702. The quantization gain is applied to a control input of the amplifier 702 and the output of the amplifier comprises a second input to first summing stage 704, to form the simulated output signal. The simulated output signal is applied to first subtraction stage 718, where the input signal is subtracted, and the output of the first subtraction stage 718 is applied to shaping filter 710.

In operation, the output of the shaping filter 710 is added to the input signal in second summing stage 706. Then a white noise signal is added after being multiplied in the amplifier 702 by the quantization gain pertaining to the subframe. The white noise signal has a variance equal to the expected variance of the quantization noise in the noise shaping quantizer 616.

For a uniform scalar quantizer with quantization step size D, the variance of the quantization noise is $D^2/12$. The result after adding the white noise signal constitutes the simulated output signal. The high-pass filtered input signal is subtracted from the simulated output signal to create a simulated coding noise signal $d_{sim}(n)$, which is input to the shaping filter 710.

The shaping filter 710 inputs the simulated coding noise signal to a short-term shaping filter 712, which uses the short-term shaping coefficients $a_{shape}$ to create a short-term shaping signal $s_{short}(n)$, according to the formula:

$$s_{short}(n) = \sum_{i=1}^{16} d_{sim}(n-i)a_{shape}(i).$$

The short-term shaping signal is subtracted from the simulated coding noise signal to create a shaping residual signal f(n). The shaping residual signal is input to a long-term shaping filter 714 which uses the long-term shaping coefficients $b_{shape}$ to create a long-term shaping signal $s_{long}(n)$, according to the formula:

$$s_{long}(n) = \sum_{i=-2}^{2} f(n-\text{lag}+i)b_{shape}(i).$$

The short-term and long-term shaping signals are added together to create the shaping filter output signal.

The simulated output signal is input to the linear prediction coding (LPC) analysis block 704, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

The LPC coefficients are transformed to a line spectral frequency (LSF) vector. The LSFs are quantized using a multi-stage vector quantizer (MSVQ) with 10 stages, producing 10 LSF indices that together represent the quantized LSFs. The quantized LSFs are transformed back to produce the quantized LPC coefficients aQ for use in the noise shaping quantizer 616.

For voiced frames, a long-term prediction analysis is performed on the LPC residual. The LPC residual $r_{LPC}$ is supplied from the LPC analysis block 304 to the LTP analysis block 310. For each subframe, the LTP analysis block 310 solves normal equations to find five linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n-\text{lag}-i)b_i$$

is minimized.

The LTP coefficients for each frame are quantized using a vector quantizer (VQ). The resulting VQ codebook index is input to the arithmetic coder, and the quantized LTP coefficients $b_Q$ are input to the noise shaping quantizer.

Figure 8:
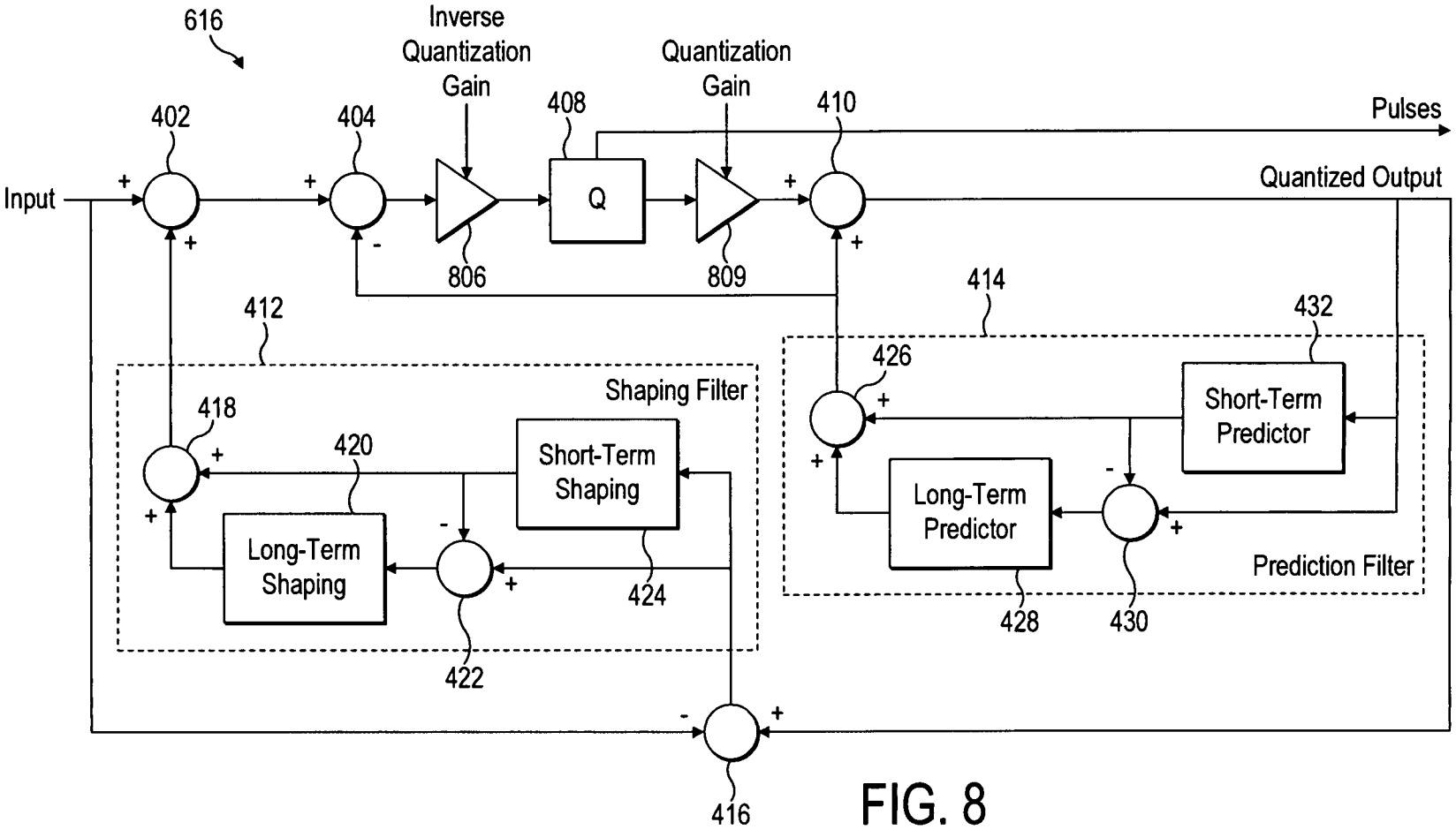
FIG. 8 shows the noise shaping quanitizer of FIG. 6.

An example of the noise shaping quantizer 616 is now discussed in relation to FIG. 8.

The noise shaping quantizer 616 is similar to the noise shaping quantizer shown in FIG. 4, but further comprises a first amplifier 806 and a second amplifier 809.

The first addition stage 402 has an input arranged to receive the high-pass filtered input from the high-pass filter 302, and another input coupled to an output of the third addition stage 418. The first subtraction stage has inputs coupled to outputs of the first addition stage 402 and fourth addition stage 426. The first amplifier has a signal input coupled to an output of the first subtraction stage and an output coupled to an input of the scalar quantizer 8408. The first amplifier 406 also has a control input coupled to the output of the noise shaping analysis block 604. The scalar quantizer 408 has outputs coupled to inputs of the second amplifier 809 and the arithmetic encoding block 318. The second amplifier 809 also has a control input coupled to the output of the noise shaping analysis block 604, and an output coupled to the an input of the second addition stage 410. The other input of the second addition stage 410 is coupled to an output of the fourth addition stage 426. An output of the second addition stage is coupled back to the input of the first addition stage 402, and to an input of the short-term prediction block 432 and the fourth subtraction stage 430. An output of the short-term prediction block 432 is coupled to the other input of the fourth subtraction stage 430. The fourth addition stage 426 has inputs coupled to outputs of the long-term prediction block 428 and short-term prediction block 432. The output of the second addition stage 410 is further coupled to an input of the second subtraction stage 416, and the other input of the second subtraction stage 416 is coupled to the input from the high-pass filter 302. An output of the second subtraction stage 416 is coupled to inputs of the short-term shaping block 424 and the third subtraction stage 422. An output of the short-term shaping block 424 is coupled to the other input of the third subtraction stage 422. The third addition stage 818 has inputs coupled to outputs of the long-term shaping block 820 and short-term prediction block 424.

In operation, all gains and filter coefficients and gains are updated for every subframe, except for the LPC coefficients, which are updated once per frame.

The noise shaping quantizer 616 generates a quantized output signal that is identical to the output signal ultimately generated in the decoder. The input signal is subtracted from this quantized output signal at the second subtraction stage 416 to obtain the quantization error signal d(n). The quantization error signal is input to a shaping filter 412, described in detail later. The output of the shaping filter 412 is added to the input signal at the first addition stage 402 in order to effect the spectral shaping of the quantization noise. From the resulting signal, the output of the prediction filter 414, described in detail below, is subtracted at the first subtraction stage 404 to create a residual signal. The residual signal is multiplied at the first amplifier 806 by the inverse quantized quantization gain from the noise shaping analysis block 604, and input to the scalar quantizer 408. The quantization indices of the scalar quantizer 408 represent an excitation signal that is input to the arithmetically encoder 318. The scalar quantizer 408 also outputs a quantization signal, which is multiplied at the second amplifier 809 by the quantized quantization gain from the noise shaping analysis block 604 to create an excitation signal. The output of the prediction filter 414 is added at the second addition stage to the excitation signal to form the quantized output signal. The quantized output signal is input to the prediction filter 414.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is the output.

The shaping filter 412 inputs the quantization error signal d(n) to a short-term shaping filter 424, which uses the short-term shaping coefficients $a_{shape,i}$ to create a short-term shaping signal $s_{short}(n)$, according to the formula:

$$s_{short}(n) = \sum_{i=1}^{16} d(n-i)a_{shape,i}.$$

The short-term shaping signal is subtracted at the third addition stage 422 from the quantization error signal to create a shaping residual signal f(n). The shaping residual signal is input to a long-term shaping filter 420 which uses the long-term shaping coefficients $b_{shape,i}$ to create a long-term shaping signal $s_{long}(n)$, according to the formula:

$$s_{long}(n) = \sum_{i=-2}^{2} f(n-\text{lag}-i)b_{shape,i}.$$

The short-term and long-term shaping signals are added together at the third addition stage 418 to create the shaping filter output signal.

The prediction filter 414 inputs the quantized output signal y(n) to a short-term prediction filter 432, which uses the quantized LPC coefficients $a_Q$ to create a short-term prediction signal $p_{short}(n)$, according to the formula:

$$p_{short}(n) = \sum_{i=1}^{16} y(n-i)a_Q(i).$$

The short-term prediction signal is subtracted at the fourth subtraction stage 430 from the quantized output signal to create an LPC excitation signal $e_{LPC}(n)$. The LPC excitation signal is input to a long-term prediction filter 428 which uses the quantized long-term prediction coefficients $b_Q$ to create a long-term prediction signal $p_{long}(n)$, according to the formula:

$$p_{long}(n) = \sum_{i=-2}^{2} e_{LPC}(n-\text{lag}-i)b_Q(i).$$

The short-term and long-term prediction signals are added together at the fourth addition stage 426 to create the prediction filter output signal.

The LPC indices, LTP indices, quantization gains indices, pitch lags and the excitation quantization indices are each arithmetically encoded and multiplexed by the arithmetic encoder 318 to create the payload bitstream. The arithmetic encoder 318 uses a look-up table with probability values for each index. The look-up tables are created by running a database of speech training signals and measuring frequencies of each of the index values. The frequencies are translated into probabilities through a normalization step.

Figure 9:
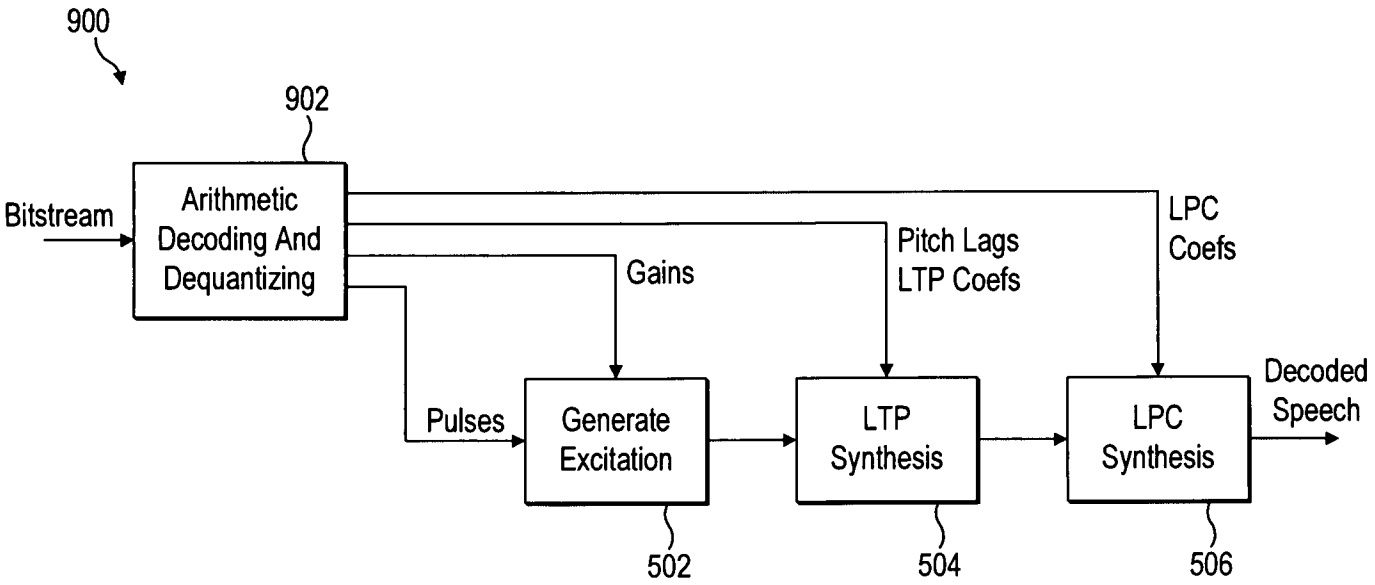
FIG. 9 shows a decoder suitable for decoding a signal encoded using the encoder of FIG. 6.

An example decoder 900 for use in decoding a signal encoded according to embodiments of the present invention is now described in relation to FIG. 9.

The decoder 900 comprises an arithmetic decoding and dequantizing block 902, an excitation generation block 502, an LTP synthesis filter 504, and an LPC synthesis filter 506. The arithmetic decoding and dequantizing block 902 has an input arranged to receive an encoded bitstream from an input device such as a wired modem or wireless transceiver, and has outputs coupled to inputs of each of the excitation generation block 502, LTP synthesis filter 504 and LPC synthesis filter 506. The excitation generation block 502 has an output coupled to an input of the LTP synthesis filter 504, and the LTP synthesis block 504 has an output connected to an input of the LPC synthesis filter 506. The LPC synthesis filter has an output arranged to provide a decoded output for supply to an output device such as a speaker or headphones.

At the arithmetic decoding and dequantizing block 902, the arithmetically encoded bitstream is demultiplexed and decoded to create LSF indices, LSF interpolation factor, LTP codebook index and LTP indices, quantization gains indices, pitch lags and a signal of excitation quantization indices. The LSF indices are converted to quantized LSFs by adding the codebook vectors of the ten stages of the MSVQ. Using the interpolation factor and the transmitted The LTP codebook index is used to select an LTP codebook, which is then used to convert the LTP indices to quantized LTP coefficients. The gains indices are converted to quantization gains, through look ups in the gain quantization codebook. The LTP indices and gains indices are converted to quantized LTP coefficients and quantization gains, through look ups in the quantization codebooks.

At the excitation generation block, the excitation quantization indices signal is multiplied by the quantization gain to create an excitation signal e(n).

The excitation signal is input to the LTP synthesis filter 504 to create the LPC excitation signal $e_{ltp}(n)$ according to:

$$e_{LTP}(n) = e(n) + \sum_{i=-2}^{2} e(n-\text{lag}-i)b_Q(i),$$

using the pitch lag and quantized LTP coefficients $b_Q$.

The long term excitation signal is input to the LPC synthesis filter to create the decoded speech signal y(n) according to:

$$y(n) = e_{LPC}(n) + \sum_{i=1}^{16} e_{LPC}(n-i)a_Q(i),$$

using the quantized LPC coefficients $a_Q$.

The encoder 600 and decoder 900 are preferably implemented in software, such that each of the components 302 to 318, and 602 to 606, and 902, 502 to 506 comprise modules of software stored on one or more memory devices and executed on a processor. A preferred application of the present invention is to encode speech for transmission over a packet-based network such as the Internet, preferably using a peer-to-peer (P2P) system implemented over the Internet, for example as part of a live call such as a Voice over IP (VoIP) call. In this case, the encoder 600 and decoder 900 are preferably implemented in client application software executed on end-user terminals of two users communicating over the P2P system.

Thus, according to some embodiments of the present invention, a signal is generated in the encoder 600 that matches the spectral characteristics of the output signal. By performing short-term and long-term prediction analysis on that simulated signal, instead of on the input signal, the prediction gain of the prediction filters is improved. This results in a lower entropy of the quantization indices, thus reducing the bitrate required to transmit the encoded speech signal. Therefore, embodiments of the invention allow coding efficiency to be increased.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method of encoding speech according to a source-filter model, the speech modelled to comprise a source signal filtered by a time-varying filter, the method comprising:

receiving a speech signal, the speech signal comprising successive frames;

for each of the frames of the speech signal:

adding, by a first signal-processing module, a predetermined noise signal to the speech signal to generate a simulated signal, the predetermined noise signal generated by combining a white noise signal with a quantization gain value, the quantization gain value calculated as a constant multiplied by a square root of residual energy from a noise shaping analysis, wherein for voiced frames of the speech signal, the quantization gain value is further multiplied by 0.5 times an inverse of a pitch correlation determined by a pitch analysis;

determining, by a second signal-processing module, linear predictive coding coefficients based on the simulated signal frame and determining a linear predictive coding residual signal based on the linear predictive coding coefficients and one of the speech signal or the simulated signal;

generating a quantized residual signal based on the linear predictive coding residual signal;

and forming, by a third signal-processing module, an encoded signal representing said speech signal by arithmetically encoding the quantized residual signal and the linear predictive coding coefficients.

2. The method according to claim 1, wherein generating the quantized residual signal further comprises generating an associated quantization noise signal, and wherein said predetermined noise signal comprises white noise having a variance equal to a variance of the quantization noise signal.

3. An encoder for encoding speech according to a source-filter model, the speech modelled to comprise a source signal filtered by a time-varying filter, the encoder comprising:

an input configured to receive a speech signal, the speech signal comprising successive frames;

a first signal-processing module configured to generate, for each of the frames of the speech signal, a simulated signal frame by adding a predetermined noise signal to each of the speech signal frames, the predetermined noise signal generated by combining a white noise signal with a quantization gain value, the quantization gain value calculated as a constant multiplied by a square root of residual energy from a noise shaping analysis, wherein for voiced frames of the speech signal, the quantization gain value is further multiplied by 0.5 times an inverse of a pitch correlation determined by a pitch analysis;

a second signal-processing module configured to determine linear predictive coding coefficients based on the simulated signal frame, the second signal-processing module further configured to determine a linear predictive coding residual signal based on the input speech signal and the linear predictive coding coefficients;

a third signal-processing module configured to generate a quantized residual signal based on the linear predictive coding residual signal; and a fourth signal-processing module configured to form an encoded signal representing the speech signal by arithmetically encoding the quantized residual signal and the linear predictive coding coefficients.

4. The encoder according to claim 3, wherein generating the quantized residual signal further generates an associated quantization noise signal, and wherein said first signal-processing module is further configured to generate the predetermined noise signal to include white noise having a variance equal to a variance of the quantization noise.

5. The encoder according to claim 3 wherein the second signal-processing module comprises a linear predictive coding analysis module.

6. The encoder of claim 3, wherein the third signal-processing module comprises a noise shaping quantizer module.

7. One or more hardware memory devices having code stored thereon that, when executed by a processor, performs a method comprising:

receiving a speech signal, the speech signal comprising successive frames;

for each of the frames of the speech signal:

adding a predetermined noise signal to the input speech signal to generate a simulated signal, the predetermined noise signal generated by combining a white noise signal with a quantization gain value, the quantization gain value calculated as a constant multiplied by a square root of residual energy from a noise shaping analysis, wherein for voiced frames of the speech signal, the quantization gain value is further multiplied by 0.5 times an inverse of a pitch correlation determined by a pitch analysis;

determining linear predictive coding coefficients based on the simulated signal frame;

determining a linear predictive coding residual signal based on the speech input signal and the linear predictive coding coefficients;

generating a quantized residual signal based on the linear predictive coding residual signal; and forming an encoded signal representing said speech signal by arithmetically encoding the quantized residual signal and the linear predictive coding coefficients.

8. The one or more hardware memory devices according to claim 7, wherein generating the quantized residual signal further comprises generating an associated quantization noise signal, and wherein said predetermined noise signal comprises white noise having a variance equal to a variance of the quantization noise signal.

* * * * *